US006868570B2

(12) United States Patent
Sanders et al.

(10) Patent No.: US 6,868,570 B2
(45) Date of Patent: Mar. 22, 2005

(54) TOOL FOR OPENING UTILITY VAULT LIDS

(76) Inventors: Richard G. Sanders, 2175 Jenni La., Tracy, CA (US) 95377; James W. Gotcher, 2045 Jenni La., Tracy, CA (US) 95377

( * ) Notice: Subject to any disclaimer, the term of this patent is extended or adjusted under 35 U.S.C. 154(b) by 64 days.

(21) Appl. No.: 10/420,556

(22) Filed: Apr. 22, 2003

(65) Prior Publication Data

US 2003/0221263 A1 Dec. 4, 2003

Related U.S. Application Data

(60) Provisional application No. 60/384,272, filed on May 31, 2002.

(51) Int. Cl.[7] ..... B25B 13/00; B25F 1/00

(52) U.S. Cl. ..... 7/138; 7/166; 7/143

(58) Field of Search ..... 7/138, 166, 143, 7/145, 169, 170

(56) References Cited

U.S. PATENT DOCUMENTS 1,689,585 A * 10/1928 Haschart ..... 81/125.1
4,685,164 A * 8/1987 Sebalos ..... 7/138
4,924,544 A * 5/1990 Culotta ..... 7/138
5,479,670 A * 1/1996 Coffey ..... 7/138
6,431,523 B2 * 8/2002 Goldman ..... 254/1

* cited by examiner

*Primary Examiner*—Joseph J. Hail, III
*Assistant Examiner*—Alvin J Grant
(74) *Attorney, Agent, or Firm*—Silicon Edge Law Group LLP; Darien K. Wallace

(57) ABSTRACT

A hand tool is usable as a wrench and a hook. One end of the tool has a hand grip and the other end a hook. The hook has a pry tip usable to pry open service vault lids. A wrench socket is disposed on the hand grip. The hook is usable as a handle to rotate the wrench socket on the opposite end of the tool. Maintenance crews can use the built-in wrench to remove bolts from vault lids without kneeling down. The tool can then be reversed and used as a hook to lift the vault lid without bending down to grasp the edge of the vault lid. This can reduce back injuries to maintenance crews. In addition, injuries from snake and spider bites are reduced because maintenance crews need not use their hands to pry open the vault lids.

20 Claims, 6 Drawing Sheets

TOOL FOR OPENING UTILITY VAULT LIDS

CROSS REFERENCE TO RELATED APPLICATION

This application claims the benefit under 35 U.S.C. §119 of the provisional application Ser. No. 60/384,272, entitled "The Vault Tool", with filing date May 31, 2002. The subject matter of provisional application Ser. No. 60/384,272 is incorporated herein by reference.

TECHNICAL FIELD

The present invention relates to tools for removing vault lids and manhole covers. More specifically, the invention relates to a dual use manual tool.

BACKGROUND

One of the common tasks performed by maintenance crews of utility companies is to open in-ground service boxes (also called vaults). The maintenance crews gain access to electrical cables, telephone wires, cable television cables and natural gas pipes through these vaults. The vaults are typically covered by lids that are secured by hold-down bolts.

Today, maintenance crews out in the field open vault lids using customarily available tools. Such tools include a wrench socket and a socket wrench handle, as well as a crowbar, a claw hammer or even a screw driver. Maintenance workers typically arrive at a job site in a service truck, gather the customary tools from a tool box in the service truck. The workers search for a particular socket from among a set of sockets for turning different sizes of bolts and nuts. The workers then carry the tools to the vault lid in their pockets and hands. The amount of weight that a maintenance worker can carry is limited. Thus, maintenance crews do not typically carry an entire tool box to the vault lid.

Most of the lids of vaults for a particular utility company typically have the same size and type of hold-down bolts. For example, the hold-down bolts on the vault lids of a particular telephone company might mostly have ¾-inch hexagonal bolt heads. Over time, the ¾-inch wrench socket in the tool boxes of many service trucks will become lost, as maintenance workers leave the sockets at the vault, leave the sockets in their pockets or drop the sockets onto the ground or into the vault.

A maintenance worker first kneels down to unscrew the hold-down bolts with a socket wrench. After the maintenance worker removes the hold-down bolts, he typically bends over to the ground and pries open the vault lid with a crowbar, claw hammer or screw driver. Then, still bent over, he grabs the lid with his hands and pulls it up and open. As this conventional method of removing vault lids involves bending over, grabbing the edge of the lid and pulling, it often results in back injuries.

Thus, a method of opening vault lids is sought in which it is less likely that a maintenance crew will misplace a wrench socket. Moreover, a tool is sought that enables a maintenance crew to open a vault lid without bending over to grab the edge of the vault lid.

SUMMARY

A multi-application tool is usable as a wrench and a pry hook. A hand grip is disposed at one end of the tool, and a hook is disposed at the other end. The hook has a pry tip that can be used to pry open service boxes and maintenance vault lids. In a first embodiment, a wrench socket is integrally formed on the hand grip. In another embodiment, the wrench socket can be removably attached to the hand grip. The hook can be used as a handle to rotate the wrench socket on the opposite end of the tool. The tool can, therefore, be used to remove bolts from vault lids without kneeling down. The tool can then be reversed and used as a hook to pry open and lift the vault lid without bending down to grasp the edge of the vault lid.

A method provides a wrench socket on a first end of a tool and a hook with a pry tip on a second end of the tool. The wrench socket is placed over a bolt head of a bolt that secures a lid of a vault box. The bolt is unscrewed by rotating the tool. The vault lid is lifted using the hook of the tool.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 1:
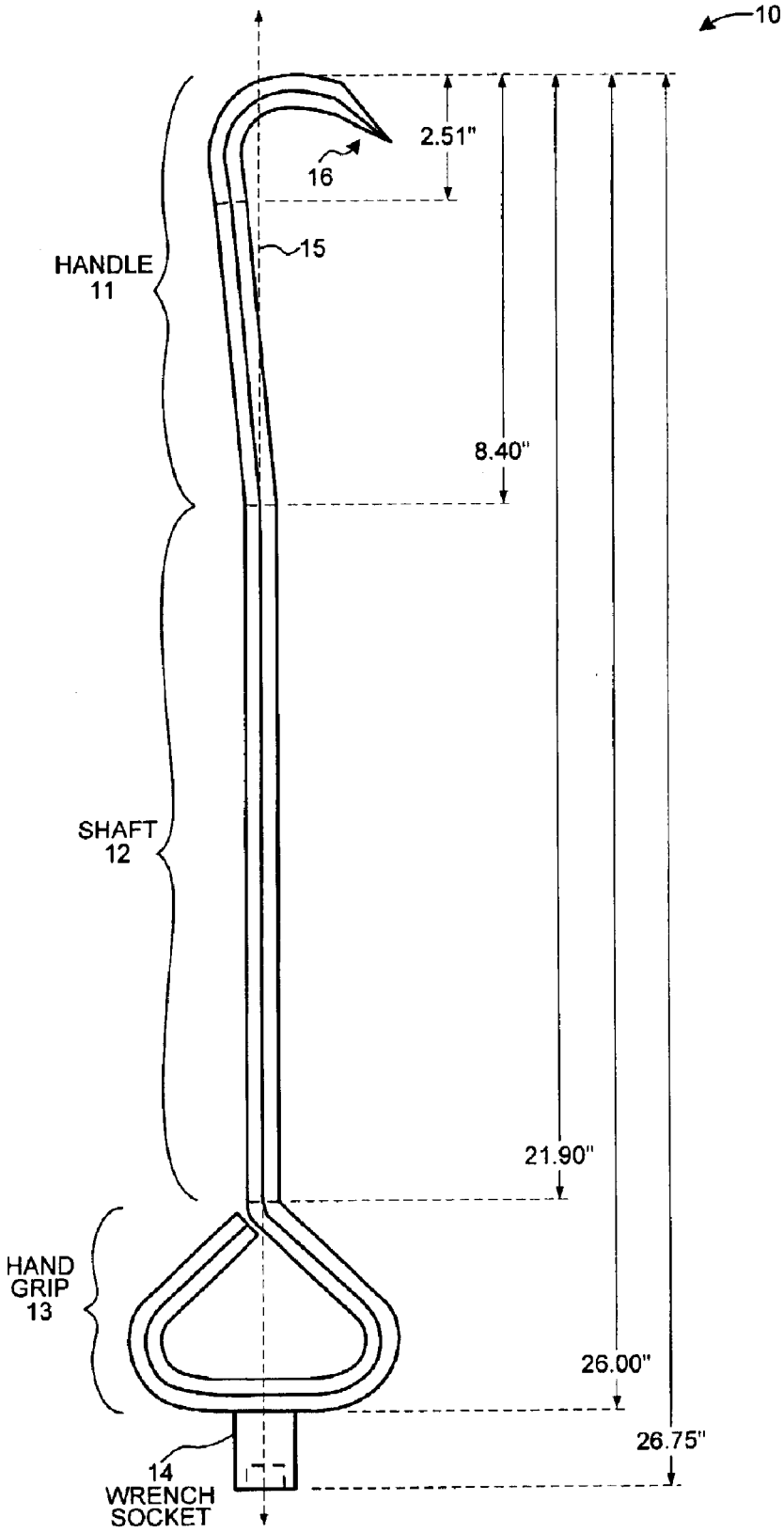
FIG. 1 is a side view of a tool for opening vault boxes of the present invention.

Reference will now be made in detail to some embodiments of the invention, examples of which are illustrated in the accompanying drawings. FIG. 1 shows a specific embodiment of a tool 10 that is usable to open utility vault lids. Tool 10 is a rigid hand-held device with a handle 11, a shaft 12 and a hand grip 13. Attached to hand grip 13 is a wrench socket 14. Shaft 12 is substantially straight and has an axis 15. Wrench socket 14 is attached at a position on hand grip 13 that is in line with axis 15. Tool 10 is formed from a single metal rod that has a substantially hexagonal cross section.

Handle 11 has a hook shape that ends in a pry tip 16. In a first embodiment of tool 10, the opening of the hook shape of handle 11 is sufficiently large to accommodate the four fingers of a maintenance worker's hand. Handle 11 extends in a dimension perpendicular to axis 15, for example, a distance greater than three inches. This allows a maintenance worker comfortably to grab handle 11.

Axis 15 passes through a portion of handle 11 that is substantially perpendicular to axis 15. Torque can be applied to wrench socket 14 by manually twisting handle 11 to rotate tool 10 about axis 15.

Handle 11 and shaft 12 have a combined length of about two feet in the first embodiment of tool 10. The entire length of tool 10 in the first embodiment is about thirty inches.

Figure 2:
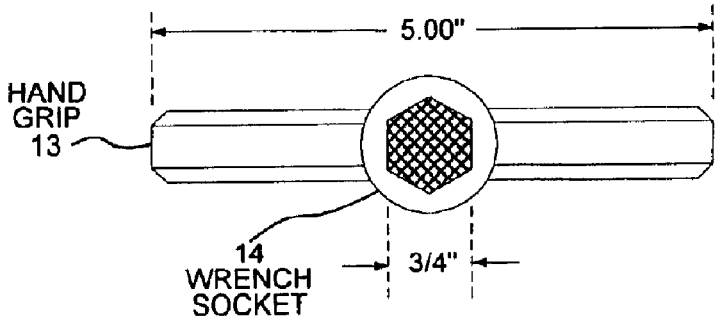
FIG. 2 is an end view of a hand grip on the tool of FIG. 1.

FIG. 2 is an end view of hand grip 13 of tool 10 as viewed looking into wrench socket 14. In the first embodiment, wrench socket 14 is a ¾-inch hexagonal socket.

Figure 3:
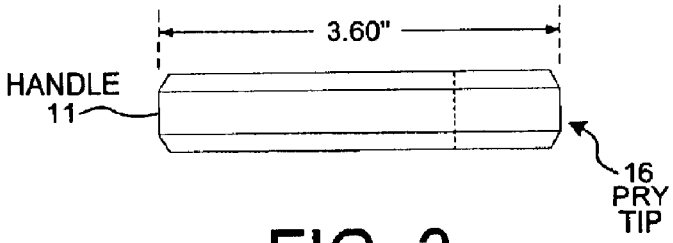
FIG. 3 is an end view of a handle on the tool of FIG. 1.

FIG. 3 is an end view of handle 11 of tool 10 as viewed along axis 15 from the side having handle 11 with pry tip 16. In the first embodiment, the outer width of the hook shape of handle 11, in the dimension perpendicular to axis 15, is 3.60 inches, and the inner width is about three inches.

Figure 4:
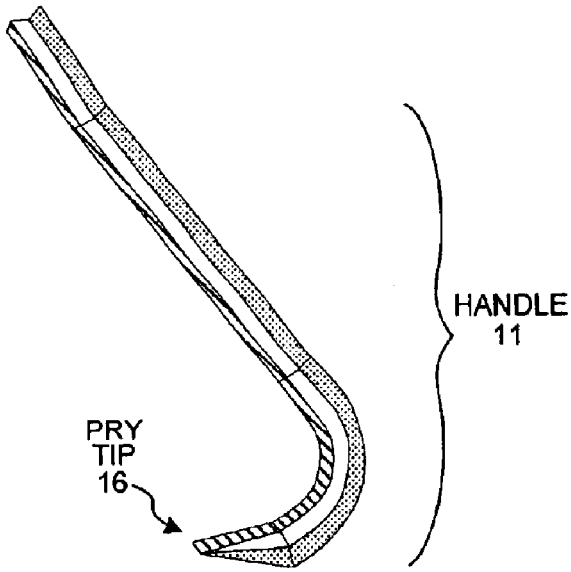
FIG. 4 is a perspective view of the handle and pry tip of the tool of FIG. 1.

FIG. 4 is a partial perspective view of tool 10 showing handle 11 and pry tip 16. In the first embodiment, the tip of pry tip 16 is a flat edge. In other embodiments, pry tip 16 has a conical shape and a pointed tip.

Figure 5:
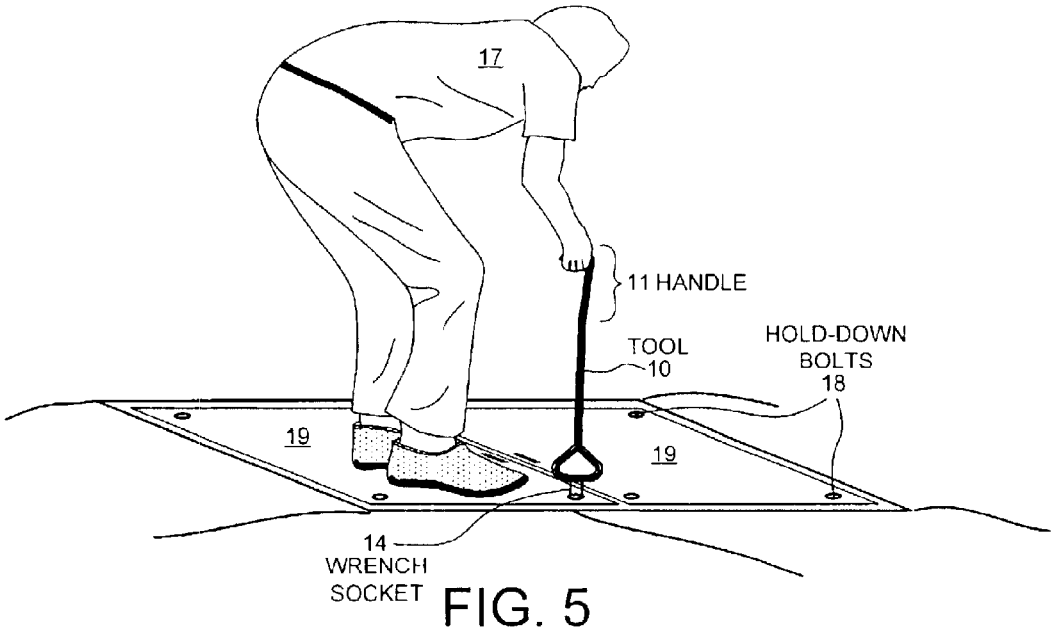
FIG. 5 is a depiction of a maintenance worker turning a hold-down bolt on a vault lid using the tool of FIG. 1.

FIG. 5 depicts a maintenance worker 17 turning one of eight hold-down bolts 18 on a vault lid 19 using tool 10. In the first embodiment, vault lid 19 covers a utility vault for a telephone company on the West Coast of the United States. Vault lids of telecommunications companies on the West Coast are typically fastened with hold-down bolts having ¾-inch hexagonal bolt heads. Therefore, wrench socket 14 of the first embodiment is a ¾-inch hexagonal (six-point) socket. In other embodiments, wrench socket 14 has a pentagonal (five-point) socket. Such penta sockets are typically used by telecommunications companies on the East Coast of the United States and by electric utility companies generally.

In FIG. 5, maintenance worker 17 has placed wrench socket 14 over a bolt head of one of the hold-down bolts 18. The bolt heads of the hold-down bolts 18 in the first embodiment are recessed in shallow cylinders on vault lid 19. Maintenance worker 17 unfastens the hold-down bolt by twisting handle 11 and rotating tool 10 about axis 15. Using tool 10, maintenance worker 17 unfastens the hold-down bolts 18 without kneeling. Although maintenance worker 17 bends over to use tool 10, he does not bend down to within a few inches of the hold-down bolts 18.

Figure 6:
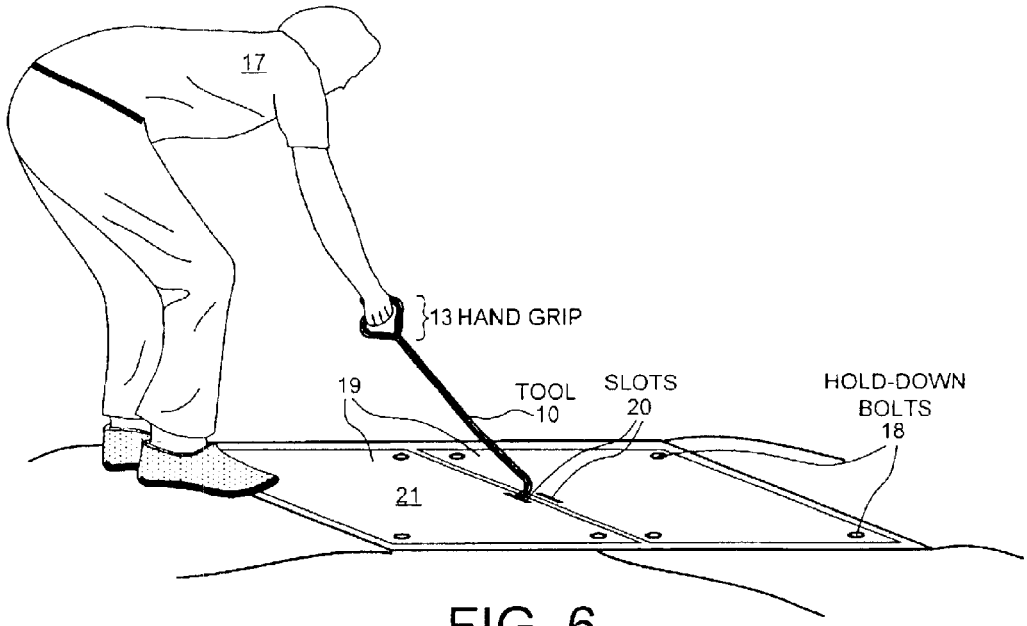
FIG. 6 is a depiction of a maintenance worker lifting a vault lid using the tool of FIG. 1.

FIG. 6 illustrates maintenance worker 17 using tool 10 to grab a hold of and lift vault lid 19. Vault lids typically have no protruding handles or hooks over which a person could trip and stumble. In the first embodiment, vault lid 19 has slots 20 into which a tool can be inserted to grasp a door 21 of vault lid 19. The slots 20 do not competely penetrate vault lid 19. Maintenance worker 17 inserts pry tip 16 into one of the slots 20 and then pulls on hand grip 13 to lift door 21 of vault lid 19. Using tool 10, maintenance worker 17 can lift door 21 without bending down to grasp the edge of door 21. By reducing the degree to which the back of maintenance worker 17 is bent during the time he exerts sufficient force to open the vault, strain on the back of maintenance worker 17 is reduced.

In a second embodiment, a ring is present within the slots 20. The ring is normally below the plane of the upper surface of vault lid 19, but can be pulled up and used to grasp door 21. In the second embodiment, pry tip 16 has a conical pointed pit, which maintenance worker 17 places through the ring and pulls. In yet other embodiments, door 21 has no slots. In those embodiments, maintenance worker 17 pries open door 21 by placing pry tip 16 in the junction between door 21 and the other door of vault lid 19.

A common injury to maintenance crews is back injury sustained while bending down to lift heavy and awkward vault lids. Using tool 10 can decrease the number of such injuries by limiting the degree to which a maintenance worker bends over while lifting vault lids. Using tool 10, it is possible to keep one's back routinely straight while lifting a vault lid. Using tool 10, it is also possible to lift a vault lid using mostly one leg muscles as opposed to one's back muscles.

Another common injury to maintenance crews is injury to the hands and fingers while trying to pry open and grasp the edge of doors of a vault lids. Although maintenance crews can use crowbars, claw hammers or even screw drivers to insert into a slot on a door or a space between doors of a vault lid, they often use their hands because it is cumbersome to carry tools in addition to a socket wrench to the vault. Moreover, it is inconvenient to return to the service truck to get such tools. Maintenance workers subject themselves to bites from venomous spiders and snakes when they use their hands to pry open doors of vault lids. Maintenance worker 17 is more likely to use handle 11 of tool 10 than a his hands, for example, to pry open vault lid 19 because maintenance worker 17 has just used wrench socket 14 on tool 10 to loosen the hold-down bolts 18 of vault lid 19. By fostering the use of back savings tool 10, companies can reduce back injuries to their maintenance workers.

Figure 7:
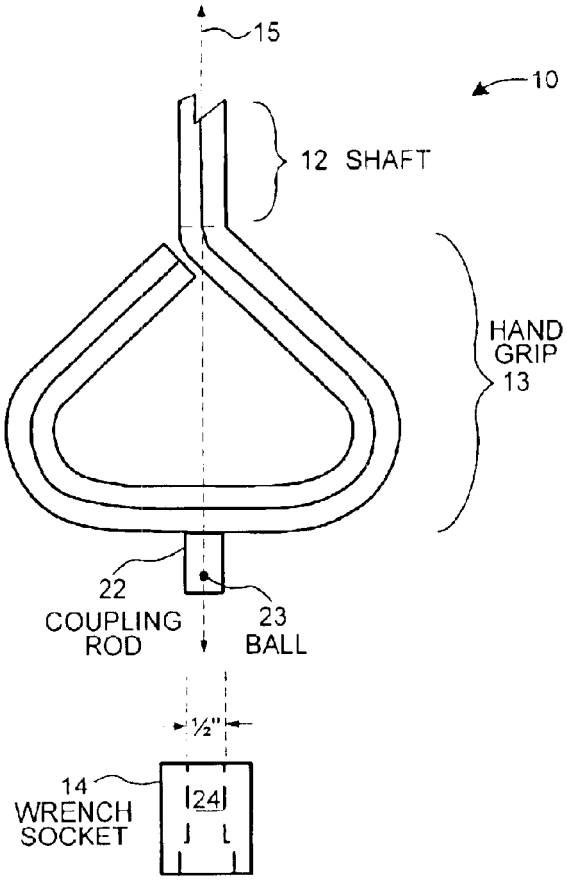
FIG. 7 is a side view of a hand grip and a coupling rod of another embodiment of the invention.

FIG. 7 shows a third embodiment of tool 10 in which wrench socket 14 is not permanently affixed to hand grip 13. Instead, a square one-half-inch-wide coupling rod 22 is attached to hand grip 13 at a position on hand grip 13 that is in line with axis 15 of shaft 12. Wrench socket 14 is releasably attached to coupling rod 22. Coupling rod 22 has a locking mechanism comprised of an embedded spring, a pin and a ball 23. Wrench socket 14 has a square one-half-inch-wide coupling hole 24 for receiving square coupling rod 22. Ball 23 protrudes from a side of coupling rod 22 and is used to secure wrench socket 14. The third embodiment of tool 10 is usable with sockets other than wrench socket 14. Maintenance worker 17 is more prone to loosing wrench socket 14 of the third embodiment, however, than wrench socket 14 of the first embodiment.

Figure 8:
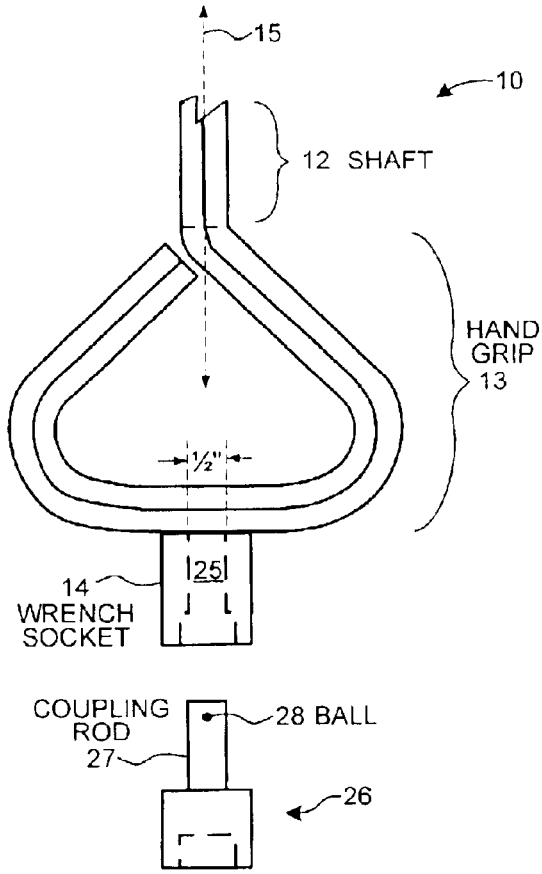
FIG. 8 is a side view of a hand grip and an adapter wrench socket of yet another embodiment of the invention.

FIG. 8 shows a fourth embodiment of tool 10 in which wrench socket 14 has a coupling hole 25. Wrench socket 14 is the size and type of socket that maintenance worker 17 primarily uses, for example, a ¾-inch hexagonal (six-point) socket. Tool 10 can be used with an additional socket 26 of different size and type by inserting a coupling rod 27 of the additional socket 26 into coupling hole 25 from the side of the socket opening. Coupling rod 27 has a locking mechanism comprised of an embedded spring, a pin and a ball 28.

Figure 9:
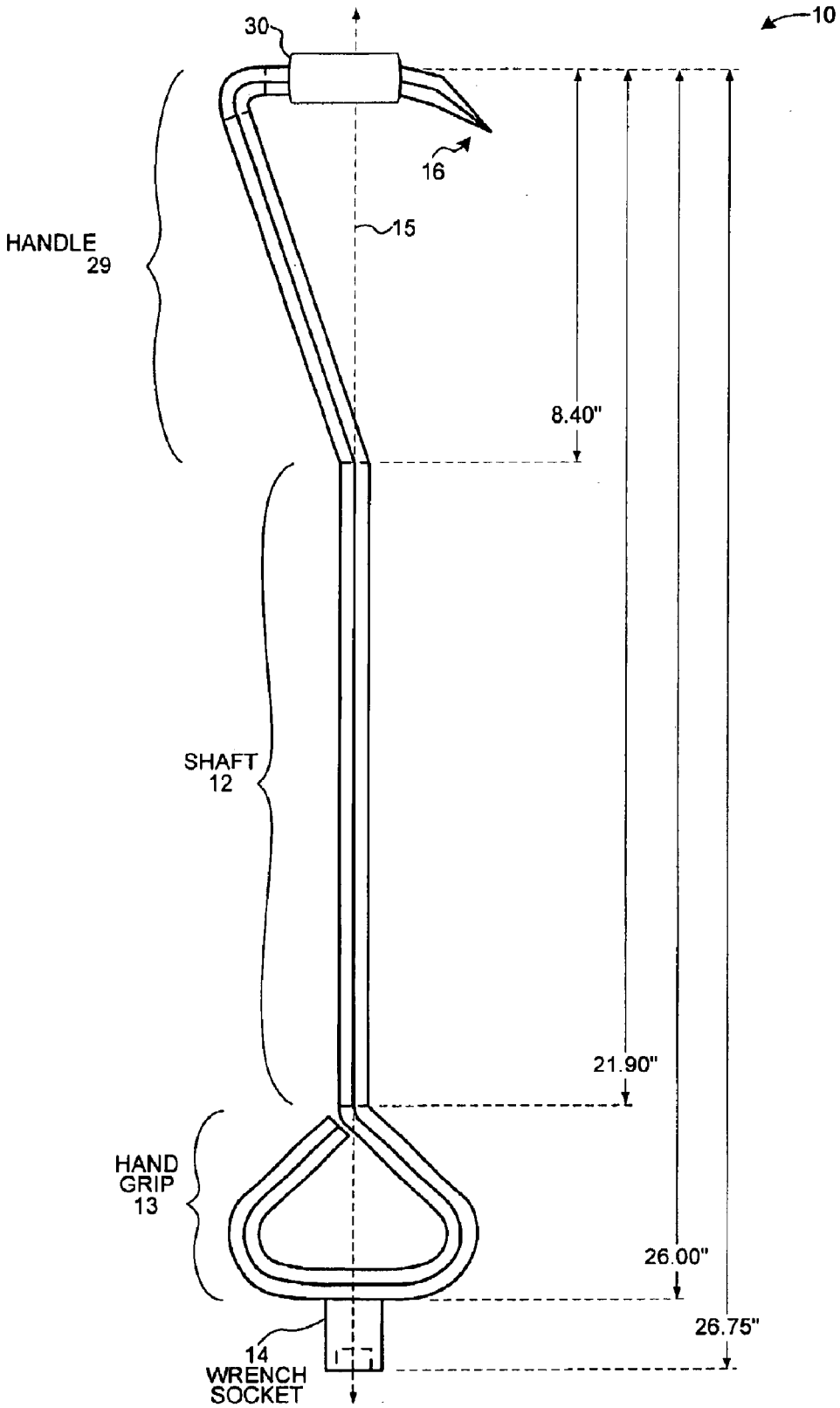
FIG. 9 is a side view of an embodiment of a tool with a modified handle for opening vault boxes.

FIG. 9 is a side view of a fifth embodiment of tool 10 with a modified handle 29. Handle 29 has a straight section that extends in a dimension perpendicular to axis 15. This allows maintenance worker 17 comfortably to grab handle 29. The longer straight section provides more torque when turning tool 10 about axis 15. The diameter of the rod forming handle 29 is greater than the diameter of shaft 12 in order to provide a comfort handle 30 that does not bite into the hand of maintenance worker 17 when he exerts force on tool 10 to loosen a stuborn bolt.

Figure 10:
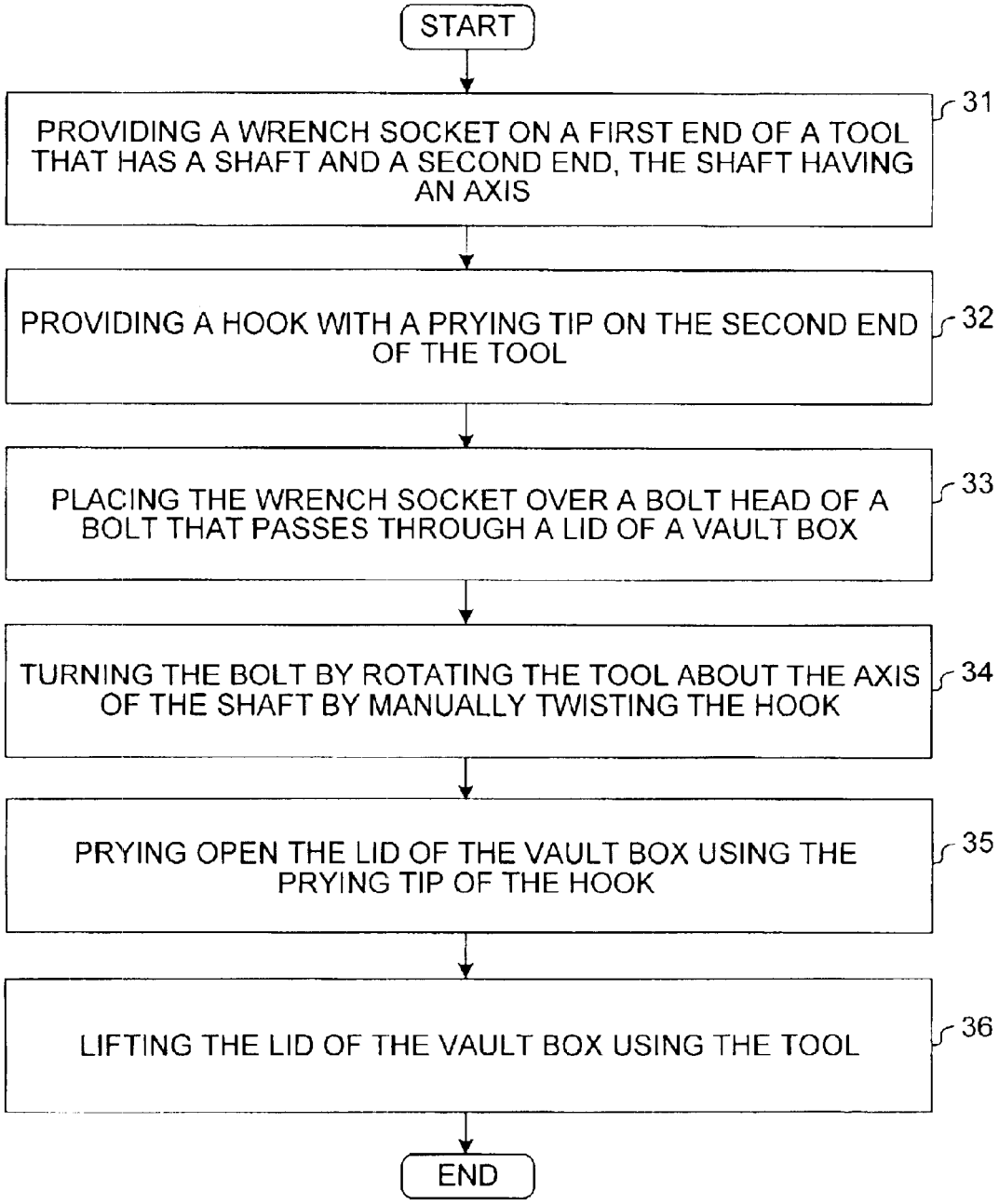
FIG. 10 is a flowchart of a method for opening the lid of a vault box in accordance with an embodiment of the present invention.

FIG. 10 is a flowchart of a method for opening the lid of a vault box in accordance with a fifth embodiment. The method involves six steps 31–36 and employs tool 10.

Although the present invention has been described in connection with certain specific embodiments for instructional purposes, the present invention is not limited thereto. In the embodiments described above, tool 10 is formed from a single metal rod that has a substantially hexagonal cross section. In other embodiments, however, tool 10 is formed from a rod having a circular cross section. Although the embodiments of the present invention are described in connection with opening a vault lid on a subsurface telephone communication line junction box, the present invention is not limited thereto. In other embodiments, for example, tool 10 is used to open lids of cable television boxes, electrical cable vaults or electrical transformer boxes or standard cast iron manhole covers on sanitary sewers or storm drains.

A wrench socket can be attached to tool 10 at a place other than hand grip 13, provided that it is attahced at a place where adequate rotational force can be applied to the socket with a bare hand to turn a hold-down bolt on a typical vault lid. A wrench socket can, for example, be attached to handle 11 such that the socket is in line with axis 15. More than one socket can be attached to tool 10. One socket can, for example, be attached on one side of hand grip 13, whereas a second socket can be attached on the other side of hand grip 13. Tool 10 need not be rotated about axis 15 to loosen hold-down bolts. Where sockets are fixed to the sides of hand grip 13, for example, the tool is rotated about an axis perpendicular to axis 15. Rather than providing a socket on hand grip 13, a screw driver tip may be provided for unscrewing large bolts that have screw heads.

Accordingly, various modifications, adaptations, and combinations of various features of the described embodiments can be practiced without departing from the scope of the invention as set forth in the claims.

What is claimed is:

1. A tool, comprising:

a shaft having a first end, a second end and an axis;

a handle positioned at said first end of said shaft, said handle having a hook shape with a pry tip;

a hand grip positioned at said second end of said shaft, wherein said hand grip has a hand grip pull surface perpendicular to said axis, said hand grin pull surface usable to pull away from said handle; and a wrench socket disposed on said hand grip.

2. The tool of claim 1, wherein said wrench socket is disposed on said hand grip at a position on said hand grip in line with said axis of said shaft.

3. The tool of claim 1, wherein said wrench socket is integrally formed as part of said combination tool.

4. The tool of claim 1, wherein said wrench socket is a three-quarter inch hexagonal wrench socket.

5. The tool of claim 1, further comprising:

a square coupling rod, wherein said square coupling rod is disposed on said hand grip at a position on said hand grip that is in line with said axis of said shaft, and wherein said wrench socket is releasably attached to said coupling rod.

6. The tool of claim 1, wherein said shaft, pry tip, handle and hand grip are metal.

7. The tool of claim 1, wherein said handle extends from said shaft in a direction substantially perpendicular to said axis of said shaft.

8. The tool of claim 1, wherein said handle and said shaft are formed of a single metal rod, said handle being a bent end portion of said metal rod, said hand grip pull surface being an inner surface of a loop formed by said metal rod.

9. The tool of claim 1, wherein said handle has handle pull surface usable to pull away from said hand grip, and wherein said handle pull surface has a length that is greater than three inches and less than five inches.

10. A method, comprising:

providing a wrench socket on a first end of a tool, said tool having a shaft and a second end, said shaft having an axis;

providing a hook on said second end of said tool, said hook having a prying tip;

placing said wrench socket over a bolt head of a bolt, said bolt passing through a lid of a vault box; and lifting said lid of said vault box using said tool.

11. The method of claim 10, further comprising:

turning said bolt by rotating said tool about said axis of said shaft by manually twisting said hook.

12. The method of claim 10, further comprising: prying open said lid of said vault box using said prying tip of said hook.

13. The method of claim 10, further comprising:

inserting said prying tip of said hook into an opening in said lid of said vault box.

14. The method of claim 10, wherein said wrench socket is positioned on a hand grip disposed between said wrench socket and said shaft, and wherein said lifting of said lid is accomplished using said hand grip.

15. The method of claim 14, wherein said wrench socket is permanently affixed to said hand grip.

16. The method of claim 10, wherein said wrench socket is integrally formed as part of said tool.

17. A tool for opening a lid of a vault box, the lid being secured by a bolt, the tool comprising:

a socket; and means for applying a rotational force to the socket to turn the bolt, and for prying open and pulling up the lid of the vault box, wherein the means is fixed to the socket and the means is at least twenty-six inches long.

18. The tool of claim 17, wherein the means includes a handle having a hook shape whose inner diameter is greater than three inches.

19. The tool of claim 1, wherein said handle has a handle pull surface, and wherein said axis passes through said handle pull surface.

20. The tool of claim 1, wherein said hand grip pull surface has a length of at least 3 inches.

* * * * *